US006499399B1

(12) United States Patent
Harenbrock et al.

(10) Patent No.: US 6,499,399 B1
(45) Date of Patent: Dec. 31, 2002

(54) PUMP INKER UNIT

(75) Inventors: Marcus Klaus Harenbrock, Würzburg (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/856,141

(22) PCT Filed: Dec. 21, 1999

(86) PCT No.: PCT/DE99/04047

§ 371 (c)(1),
(2), (4) Date: May 30, 2001

(87) PCT Pub. No.: WO00/38923

PCT Pub. Date: Jul. 6, 2000

(30) Foreign Application Priority Data

Dec. 29, 1998 (DE) ..... 198 60 625

(51) Int. Cl.[7] ..... B41F 31/02; B41F 31/08
(52) U.S. Cl. ..... 101/366; 101/349.1
(58) Field of Search ..... 101/365, 366, 101/367, 348, 349.1, 350.1, 350.6

(56) References Cited

U.S. PATENT DOCUMENTS 4,033,258 A 7/1977 Farrow ..... 101/158
4,792,292 A * 12/1988 Gaenzle ..... 101/366
5,168,807 A * 12/1992 Elia et al. ..... 101/366
5,189,956 A 3/1993 Reder et al. ..... 101/364
5,367,982 A * 11/1994 DeMoore et al. ..... 101/350.6
5,386,773 A 2/1995 Flade ..... 101/366

FOREIGN PATENT DOCUMENTS

| | | | |
|---|---|---|---|
| CH | 392 565 | 10/1965 | |
| CH | 532 429 | 2/1973 | |
| DE | 1 853 635 | 6/1962 | |
| DE | 1 225 203 | 9/1966 | |
| DE | 2 301 503 | 7/1973 | |
| DE | 2 333 279 | 10/1974 | |
| DE | 41 17 389 A1 | 3/1992 | |
| DE | 42 41 809 A1 | 6/1994 | |
| DE | 42 42 493 A1 | 6/1994 | |
| DE | 197 21 235 A1 | 3/1998 | |
| JP | 05042666 A * | 2/1993 | ..... B41F/31/08 |
| WO | WO 98/42511 | 10/1998 | |

OTHER PUBLICATIONS

Patent Abstracts of Japan JP 1–316271; Seiji Mitsui; Ink Supply Apparatus; vol. 14/No. 119; Mar. 1990.

* cited by examiner

*Primary Examiner*—Daniel J. Colilla
(74) *Attorney, Agent, or Firm*—Jones Tullar & Cooper, P.C.

(57) ABSTRACT

A pump inker unit is used to supply inks of different color to an inking unit of a rotary printing press. An ink supply unit is supported for movement with respect to the inking unit of the press. Several pump inker units, each with their own color of ink can be quickly interchanged so that the ink ductor roller of the inking unit will receive different colors of ink from different movably mounted ink supply units.

7 Claims, 1 Drawing Sheet

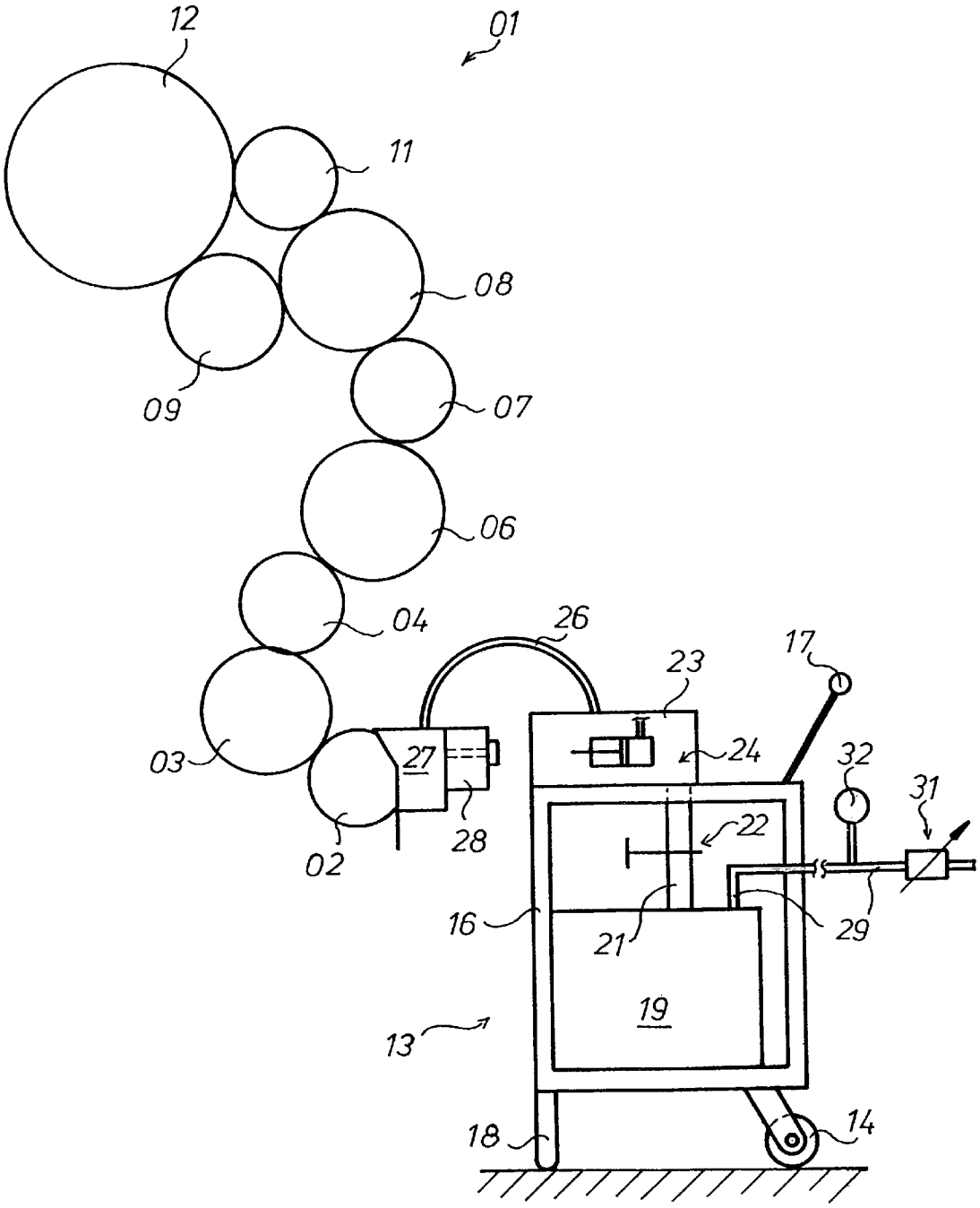
12
01
11
08
09
07
06
04
26
23
17
03
27
24
32
31
28
22
02
16
21
29
19
13
18
14

PUMP INKER UNIT

FIELD OF THE INVENTION

The present invention relates to a pump inking unit. The pump inking unit includes a movable ink supply unit which is movable and has at least two ink pumps.

DESCRIPTION OF THE PRIOR ART

An inking unit for a multi-color rotary printing press is known from Swiss Patent 392 565. For dispensing ink into the inlet wedge between two distributing rollers, ink nozzles are respectively charged by a plurality of pumps from an ink reservoir which has the width of a printing plate and which is located in the interior of the press.

DE 42 42 493 A1 describes a refilling station for filling a multi-path reservoir.

Swiss patent 532 429 discloses an inking unit with a nozzle for applying ink to a roller. The nozzle is connected with a reservoir which can be charged with compressed air.

SUMMARY OF THE INVENTION

The object of the present invention is directed to creating a pump inking unit.

In accordance with the present invention, this object is attained by providing a pump inking unit that includes an ink supply strip which can be placed against an ink roller. This ink supply strip is connected to at least two ink pumps. A movable ink supply unit with at least one ink reservoir is connected to the ink pumps. Ink in the ink reservoir is pressurized by a gaseous medium.

The advantages which can be achieved by the present invention primarily lie in that a rapid change of the printing ink color is possible without it being necessary to remove residue of the ink used up to that time, or to use it up by printing. The generation of waste printed material is reduced.

BRIEF DESCRIPTION OF THE DRAWINGS

A preferred embodiment of the present invention is represented in the sole drawing FIGURE and will be described in greater detail in what follows.

The sole drawing FIGURE shows a schematic lateral view of an inking unit with a pump inking unit in accordance with the present invention.

DESCRIPTION OF THE PREFERRED EMBODIMENT

A generally conventional inking unit, for example the inking unit 01 for an offset printing press includes an ink ductor roller 02. A screen roller 03 adjoins the ink ductor roller 02 and is, in turn, connected through a first ink transfer roller 04 with a first ink distribution roller 06. A further or second ink transfer roller 07 is arranged between the first ink distribution roller 06 and a second ink distribution roller 08 which second ink distribution roller 08 is, in turn, in contact via two parallel extending ink application rollers 09, 11 with the circumference of a forme cylinder 12, which, in turn, acts together with a rubber blanket or printing cylinder, not represented.

The inking unit 01 furthermore has, for example, an inking roller washing device, not specifically represented, which can be placed against the first ink distribution roller 06, as well as a dampening agent application unit, also not specifically represented, which can be placed against the forme cylinder 12.

An ink supply unit, generally at 13, consists, for example, of a movable support device 16, which can be mounted on wheels 14 and which has a handle 17 and support legs 18. On a lower level, the movable support device 16 carries an ink reservoir 19 containing ink which is under direct pneumatic pressure. To this end, a gaseous medium, for example compressed air, is supplied to the ink reservoir 19 through a compressed air line 29, which line 29 is provided with a setting device 31 and with a pressure indicator 32. The compressed air is supplied from a central supply installation and acts directly on the surface of the ink in the ink reservoir 19. The ink is conveyed out from the ink reservoir 19 to ink pumps 24 provided in a pump unit 23 without the ink pumps necessarily being designed for ink aspiration.

The ink reservoir 19 is connected through an ink discharge line 21, as well as through a pressure reduction valve 22, with a pump unit 23 which contains a plurality of ink pumps 24, typically six to eight ink pumps, only of which is symbolically represented in the sole g figure. Each one of the several ink pumps 24 is connected by a line or a hose 26 with a generally conventional known ink supply strip 27, which ink supply strip 27 has a plurality of ink outlet openings that are arranged next to each other and which is of a width of at least one quarter or one half the width of a cylinder.

The ink supply strip 27, which applies ink to the ink ductor roller 02, can be connected, by a cross bar 28, with a quick-acting lock fixed on the frame of the press. In accordance with another preferred embodiment, it is also possible to arrange quick-acting locks between the ink supply strip 27 and a cross bar 28 fixed on the frame of the press.

The ink pumps 24 are each driven by their own separate electric motor, for example, which electric motor operates as a function of the revolutions of the press, for example. The electric motors can be connected through a control line, not specifically represented, with the control console of the press.

All lines 26, 29, which are connected with the movable ink supply unit 13, are preferably flexible lines or hoses.

In accordance with another preferred embodiment it is moreover possible to attach additional wheels 14 on the movable support device 16 in place of the support legs 18.

It can furthermore be provided that the above mentioned wheels 14 can act together with rails, not specifically represented, which rails, for example, can extend in front of the rollers or cylinders of the inking unit 01.

By utilization of the present invention, it has become possible to perform a change of the printing ink in a very short time.

While a preferred embodiment of a pump inker unit in accordance with the present invention has been set forth fully and completely hereinabove, it will be apparent to one of skill in the art that a number of changes, for example in the type of printing press and inking unit with which the pump inker unit is to be used, and the type of material being printed could be made without departing from the true spirit and scope of the present invention which is accordingly to be limited only by the following claims.

What is claimed is:

1. A pump inker unit useable with an inking unit, said pump inker unit comprising:

an ink supply strip adapted to engage an ink ductor roller of the inking unit;

a movably supported ink supply unit;

at least one ink reservoir and at least two ink pumps on said movably supported ink supply unit;

means connecting said ink reservoir with said ink pumps;

means connecting said ink pumps with said ink supply strip; and means charging ink in said ink reservoir at a positive pressure with a gaseous medium.

2. The pump inker unit of claim 1 wherein said ink supply unit is charged with said gaseous medium through a gaseous medium supply line and further wherein said means connecting said ink pump with said ink supply strip is an ink supply line, said gaseous medium supply line and said ink supply line being flexible.

3. The pump inker unit of claim 1 wherein said ink supply unit is supported on wheels.

4. The pump inker unit of claim 3 wherein said ink supply unit includes a movable support device, said wheels being positioned on said movable support device.

5. The pump inker unit of claim 1 wherein said movably supported ink supply unit is freely movable.

6. The pump inker unit of claim 3 wherein said wheels are adapted to cooperate with support rails.

7. The pump inker unit of claim 1 wherein the ink ductor roller has a width and further wherein said ink supply unit supplies ink to at least one quarter of said width of the ink ductor roller.

* * * * *